US008759651B2

(12) United States Patent
Kosharek

(10) Patent No.: US 8,759,651 B2
(45) Date of Patent: Jun. 24, 2014

(54) TENSIONING APPARATUS AND METHOD FOR A STRINGED INSTRUMENT

(71) Applicant: EKFG Pty. Ltd., Orange (AU)

(72) Inventor: Leonard Kosharek, Orange (AU)

(73) Assignee: EKFG Pty. Ltd., Orange, NSW (AU)

( * ) Notice: Subject to any disclaimer, the term of this patent is extended or adjusted under 35 U.S.C. 154(b) by 0 days.

(21) Appl. No.: 13/851,866

(22) Filed: Mar. 27, 2013

(65) Prior Publication Data

US 2013/0276613 A1 Oct. 24, 2013

Related U.S. Application Data

(60) Provisional application No. 61/637,284, filed on Apr. 24, 2012.

(51) Int. Cl.

| | |
|---|---|
| ***G10D 3/00*** | (2006.01) |
| ***G10D 3/14*** | (2006.01) |
| ***G10D 3/04*** | (2006.01) |

(52) U.S. Cl.
CPC . *G10D 3/14* (2013.01); *G10D 3/043* (2013.01)
USPC ..... 84/318; 84/297 R

(58) Field of Classification Search
USPC ..... 84/297 R, 464
See application file for complete search history.

(56) References Cited

U.S. PATENT DOCUMENTS

| | | | | |
|---|---|---|---|---|
| 416,057 | A * | 11/1889 | Gill et al. | 84/318 |
| 3,205,751 | A * | 9/1965 | Lowe | 84/318 |
| 3,227,028 | A * | 1/1966 | Simms | 84/318 |
| 3,329,055 | A * | 7/1967 | Milliken | 84/318 |
| 3,834,267 | A * | 9/1974 | Shubb et al. | 84/318 |
| 3,903,776 | A * | 9/1975 | Owen, III | 84/318 |
| 6,005,174 | A * | 12/1999 | Regen | 84/318 |
| 6,107,554 | A * | 8/2000 | Riddle | 84/300 |
| 6,723,905 | B2 * | 4/2004 | Gillis | 84/318 |
| D514,151 | S * | 1/2006 | Fowler, Jr. | D17/20 |
| 6,998,526 | B1 * | 2/2006 | Sims et al. | 84/318 |
| 8,203,060 | B1 * | 6/2012 | Brewster | 84/318 |
| 2006/0042452 | A1 * | 3/2006 | Brown | 84/455 |
| 2013/0276613 | A1 * | 10/2013 | Kosharek | 84/297 R |

* cited by examiner

*Primary Examiner* — Robert W Horn

(57) ABSTRACT

The present invention provides a tensioning apparatus for a string of a stringed instrument, the apparatus including a supporting body portion for releasable engagement between a string and a surface of the neck of the stringed instrument at a fret on the fret board, thereby to raise the string relative to the fret on the fret board; the apparatus further including a biasing element by which lateral tension may be applied to the string.

12 Claims, 6 Drawing Sheets

TENSIONING APPARATUS AND METHOD FOR A STRINGED INSTRUMENT

This application claims the benefit of U.S. Provisional Application No. 61/637,284, filed Apr. 24, 2012.

TECHNICAL FIELD

The present invention provides means to improve the resonant tone of fretted instruments such as banjos, slide guitars, lap guitars, mandolins, guitars, by developing perpendicular tension on the string or strings when the invention is secured by means of an integral adjustable threaded tightening nut. The present invention will also maintain its correct position under the string by the inclusion of appropriate slots to accept the instrument string and a fret positioning structure over the fret. The present invention does not require any permanent attachment or modification to the instrument.

BACKGROUND

For an understanding of the present invention it is instructional to consider the mechanics of a stringed instrument. The pitch of a sound is changed by either shortening or lengthening a string so as to change the frequency of its vibration when struck. When a string is depressed between the frets of an instrument, the string is effectively shortened when it contacts the fret nearest the point of the strike. A string is depressed either by finger pressure or a mechanical device often covered with a soft material such as a rubber or rubber like material. Some of the tone of the vibrating string is absorbed by the contacting surface and thereby not totally transferred to the rest of the instrument. Additionally, as the depressed string is, in effect, pulled over the fret, the string is slightly stretched, requiring a re-tensioning of the string for the proper intonation.

In a particularly advantageous embodiment of this invention, the benefits of the invention are achieved and perform the benefits of a $5^{th}$ string banjo Capo without modifying the banjo neck with undesirable mounting holes and without creating an obstructive fixed installation as is the case with other traditional methods. This is especially important for older vintage instruments where the wood that creates the neck may be dry and brittle and prone to splitting if drilled with holes to install a Capo of traditional design. The new invention can be inserted or removed without the need for any damaging or obstructing modifications to the banjo.

A string length attenuating Capo is desirable on the 5th banjo string to make that string more like part of the musical chord when the other 4 strings employ a Capo. The traditional Capo method is to lower the string to a point below the height of the nearest fret and thereby reducing its length and thereby increasing its pitch. The two traditional Capo methods, particularly on a banjo, lower the string to contact the fret either by use of an "L" shaped railroad spike that is inverted and then inserted into holes drilled into fret board. The underside of the inverted "L" shape is situated below the top surface of the fret. The instrument string is stretched to engage the hook thereby pulling the string in contact with the fret effectively reducing its length and thereby increasing its pitch. It is well known that stretching the string to the position under the "L" shape adds tension to the string, significant enough, to cause the pitch to become more musically "sharp" and therefore requires a retuning of the string when this arrangement is used. It is also well known that the railroad spikes in this design potentially damage the string and potentially, loosen over time and therefore do not consistently create the resonant tone desired by the user. The other traditional method utilizes a clamping method that, in the case of the banjo, is mounted to the side of the banjo neck using screws inserted into drilled holes. It is well known that for proper performance, this installation requires accurate placement of the apparatus on the banjo.

Additionally, this clamping method may include a relatively soft material such as rubber on the clamping surface so as not to damage the instrument fret board when the metal string is clamped against the softer wood fret board. This rubber surface has a deleterious effect of absorbing some of the string vibration thereby dampening the resonant tone of the vibrating string. Alternatively, this method may use a metal clamping surface which, when over tightened, may depress the string strongly into contact with the wooden banjo neck, causing damage to the neck. Both methods stretch the string over the fret which adds tension to the string, significant enough, to cause the pitch to become more musically "sharp" and therefore requires a retuning of the string. There is a third but less traditional capo method that effectively shortens the string by clamping a metallic device directly to the string by pinching the string within the device and securing it with a bolt applied directly on the string. It is well known that this method potentially can damage the string but more significantly, as it is not secured to the instrument, it does not adequately transfer the string vibration to the rest of the instrument and the resonant tone is muted.

The object of the present invention is fourfold, (1) to improve the resonant tone of the capo attenuated vibrating string by providing a rigid mechanism that in effect raises the fret with a device that can be easily inserted between the fret and string thus reducing its length without increasing its pitch. This inserted string elevating mechanism does not therefore require the clamping action of a vibration dampening and pitch altering surface. Nor does it require the "hooking" action of a pitch altering "L" shaped device, thus reducing the need for retuning the string with each use or change of position. (2) the invention enhances the resonant tone by providing an adjustable mechanism that increases perpendicular tension on the string for a more efficient transfer of string vibration to the rest of the instrument, (3) the invention does not require any drilling of holes into the instrument and (4) the invention is easy to insert and remove and therefore does not hinder the hand movement of the musician when it is not needed.

It is an object of the present invention to address or at least ameliorate some of the above disadvantages or provide a useful alternative.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly, in one broad form of the invention there is provided a tensioning apparatus for a string of a stringed instrument, the apparatus including a supporting body portion for releasable engagement between a string and a surface of the neck of the stringed instrument at a fret on the fret board, thereby to raise the string relative to the fret on the fret board; the apparatus further including a biasing element by which lateral tension may be applied to the string.

Preferably the supporting body comprises a central element provided with a string retaining slot in a top portion of the central element; the supporting body further comprising stabilising plates for placement against a surface of a neck of the stringed instrument.

Preferably the supporting body portion is provided at an underside with a groove; the groove sized so as to locate over the fret with the stabilising plates in contact with the surface of the neck of the stringed instrument.

Preferably the supporting body includes an externally threaded element extending from the central element; the threaded element extending from a side of the neck when the apparatus is inserted between the fret and the string with the stabilising plates in contact with the surface of the neck for use.

Preferably, the biasing element comprises internally threaded wheel and knob elements for engagement with the externally threaded element.

Preferably, the internally threaded wheel element is further provided with a cushioning element at an inward facing side of the wheel element; the cushioning element preventing damage to a side of the neck of the instrument when the biasing element is urged into contact with the neck.

Preferably, the cushioning element is in the form of a resilient "O" ring located in an annular groove of the wheel element.

Preferably, advancing the biasing element on the externally threaded element after the biasing element has come into contact with the side of the neck, draws the supporting body portion and the string towards the side of the neck so as to displace the string laterally from its normal position, thereby applying the lateral tension to the string.

In another broad form of the invention, there is provided a capo device for use at the fifth string of a banjo musical instrument; the capo device raising the fifth string above a selected fret; the capo device characterised in providing for lateral displacement of the fifth string towards an edge of the neck of the banjo; the displacement providing an additional tensioning of the fifth string.

Preferably, the fifth string is captured in a slot of a supporting body element; the supporting body element provided with an externally threaded element extending outwardly from the edge of the neck when in use; the capo device further including an internally threaded biasing element; the biasing element laterally displacing the supporting body element and captured string when the biasing element is advanced on the threaded element against the edge of the neck of the banjo.

In another broad form of the invention, there is provided a method of applying additional tension to string of a stringed instrument at a fret along a neck of the stringed instrument; the method comprising the steps of:

(a) inserting a supporting body portion of a tensioning apparatus between the string and the fret so as to capture the string in a slot of the supporting body portion; the insertion displacing the string perpendicularly relative the surface of the neck and relative the fret, (b) advancing a biasing element of the tensioning apparatus against a side of the neck so as to draw the supporting body towards the side of the neck thereby displacing the string laterally towards the side of the neck In another broad form of the invention, there is provided a method of altering a tuning of a stringed musical instrument; the method including insertion of a capo device at a fret along a neck of the musical instrument between the surface of the neck and the string to raise the string relative the fret; the method further including urging a biasing element of the capo device against a side of the neck so as to laterally displace and tension the string.

Accordingly, in one broad form of the invention there is provided a tensioning apparatus for a stringed instrument, the apparatus including a supporting body portion for releasable, slideable engagement between a string and a fret of the stringed instrument, thereby to raise the string relative to the fret.

Preferably the releasable, slideable engagement is in a direction substantially perpendicular to the axis of the string.

Preferably including a biasing device for biasing the string in a direction perpendicular to the axis of the string.

Preferably the supporting body portion includes a slot in a top portion thereof for slideable engagement and retention of the string therewithin.

In yet another broad form of the invention there is provided a method of tensioning a string of a stringed instrument; the method comprising raising the string at a selected location of the stringed instrument, thereby to increase tension of the string.

Preferably the selected location is immediately above a selected fret of the stringed instrument.

Preferably biasing the string in a direction perpendicular to the axis of the string.

BRIEF DESCRIPTION OF DRAWINGS

Embodiments of the present invention will now be described with reference to the accompanying drawings wherein.

DETAILED DESCRIPTION OF PREFERRED EMBODIMENTS

Figure 1:
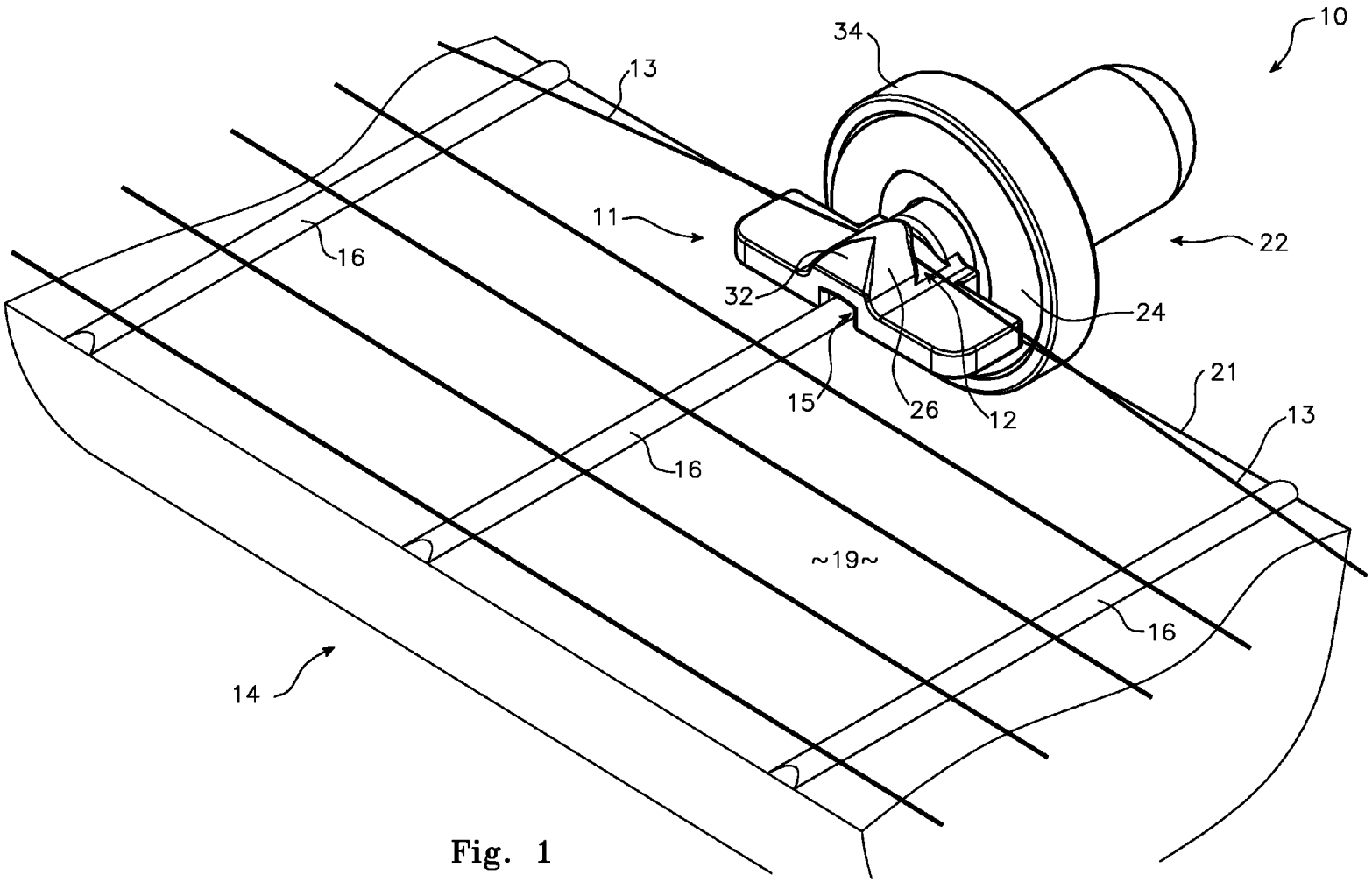
FIG. 1 is an illustration of a tensioning apparatus in use on a neck of a stringed instrument in accordance with a preferred embodiment of the present invention.
Figure 2:
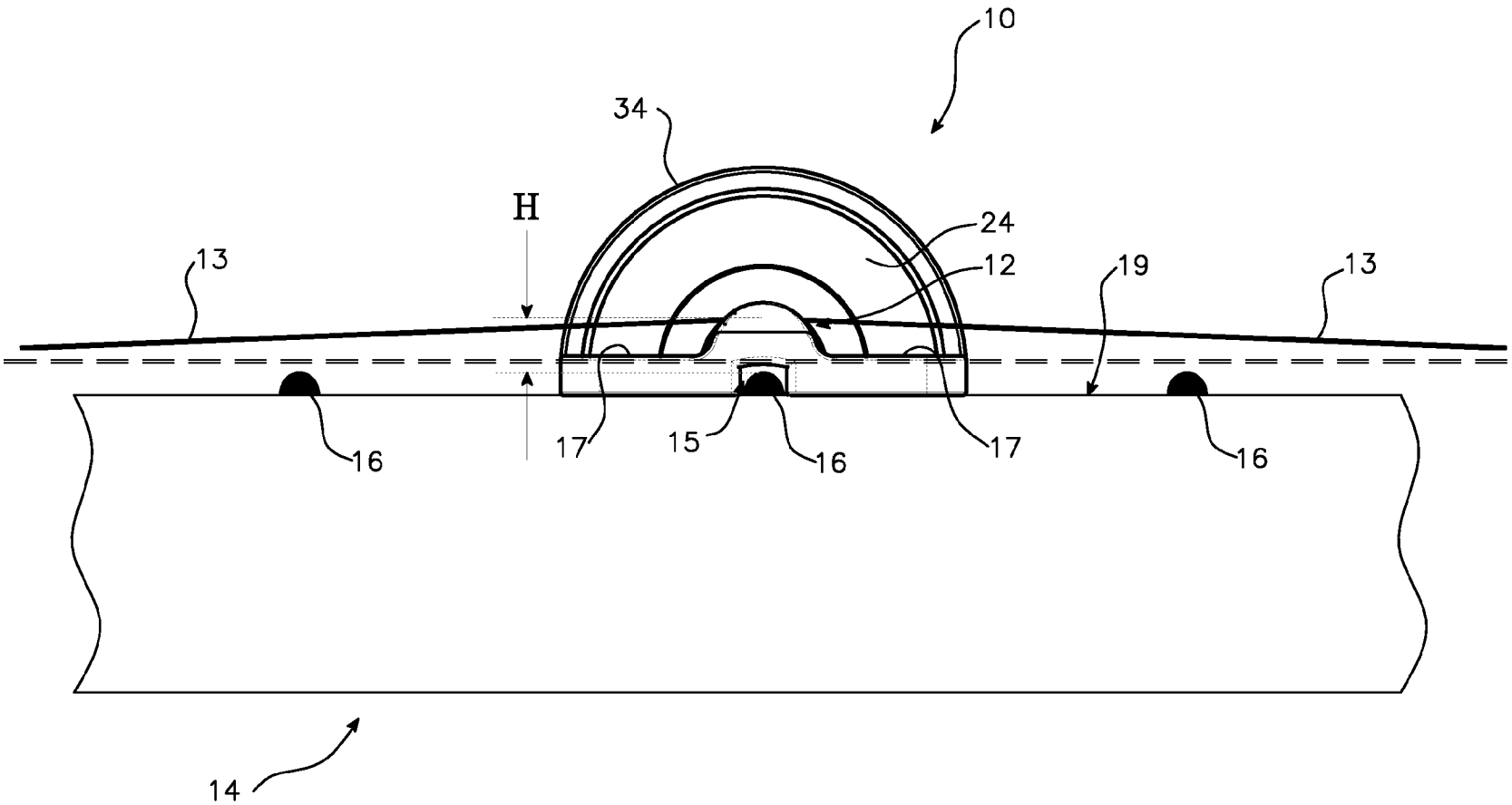
FIG. 2 is a front view of the tensioning device of FIG. 1 in use.
Figure 3:
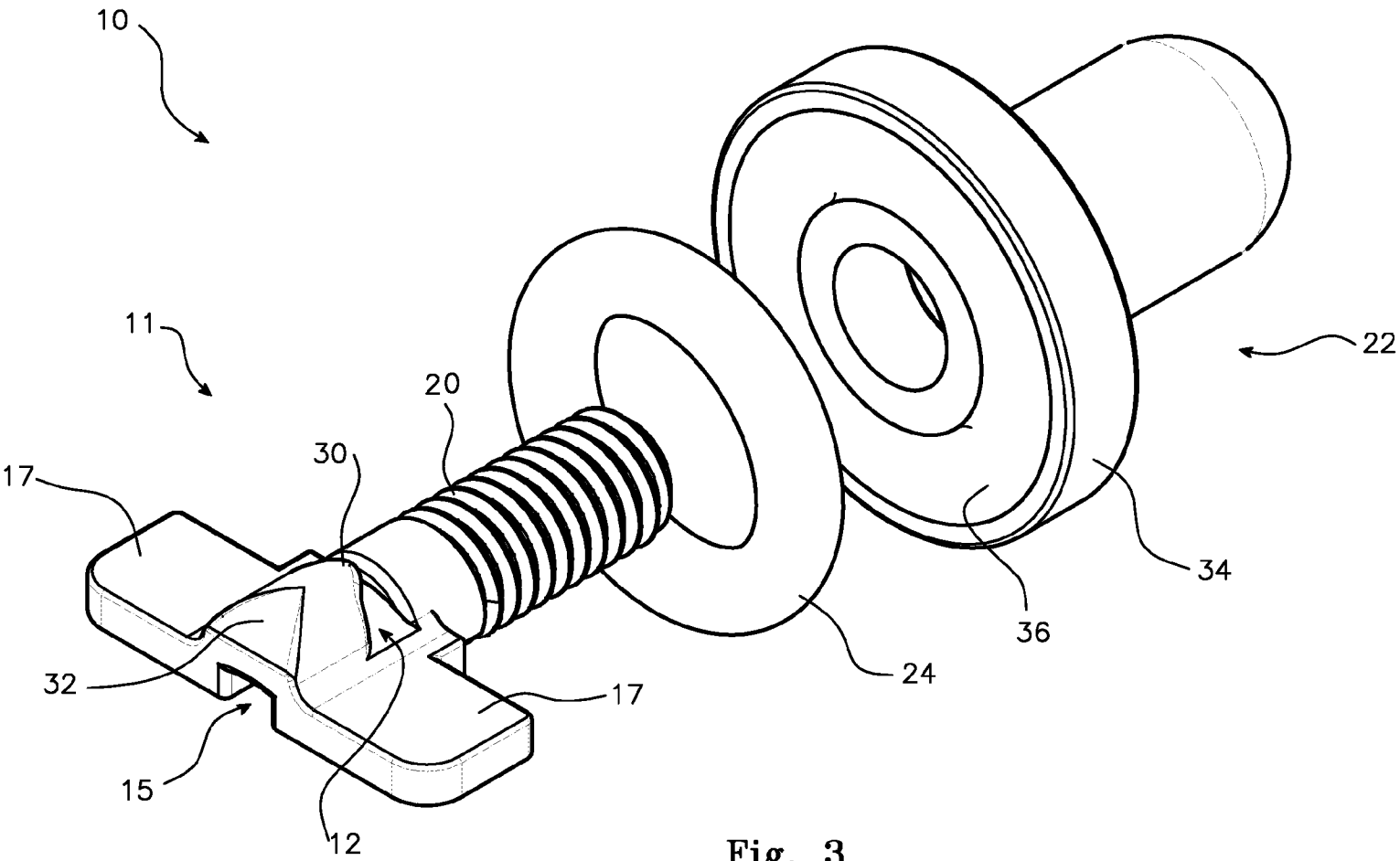
FIG. 3 is an exploded view of the tensioning apparatus of FIG. 1.

With reference to FIGS. 1 to 3, there is illustrated a tensioning apparatus 10 for tensioning a string of a stringed instrument, such as a banjo in accordance with a first preferred embodiment of the present invention. In this instance, the tensioning apparatus 10 comprises a supporting body portion 11 having a slot 12 in a top portion of a central element 26 of the body portion 11. The slot 12 is adapted to receive and support a string 13 arranged along the neck 14 of a stringed instrument (not shown).

Preferably slot 12 is provided with an overhanging lip 30. As can be seen from FIG. 6B the lip 30 of the slot 12 aids in retaining a tensioned string 13 within the slot during strong vibration of the string. The bottom of the slot is formed with a curved surface, preferably of similar radius to that of a fret, so as to minimise contact of the string with that surface of the slot. Similarly that side of the slot under the lip 30 is convexly curved, again to minimise contact with that side of the slot when the string 13 is put under lateral tension, as will be explained further below.

Preferably also, the distal end 32 of the central element 26 likewise slopes downwardly towards the centre of the instrument neck 14 when in use, to allow for the tensioning apparatus to be easily inserted between a fret 16 and a string 13.

Figure 4:
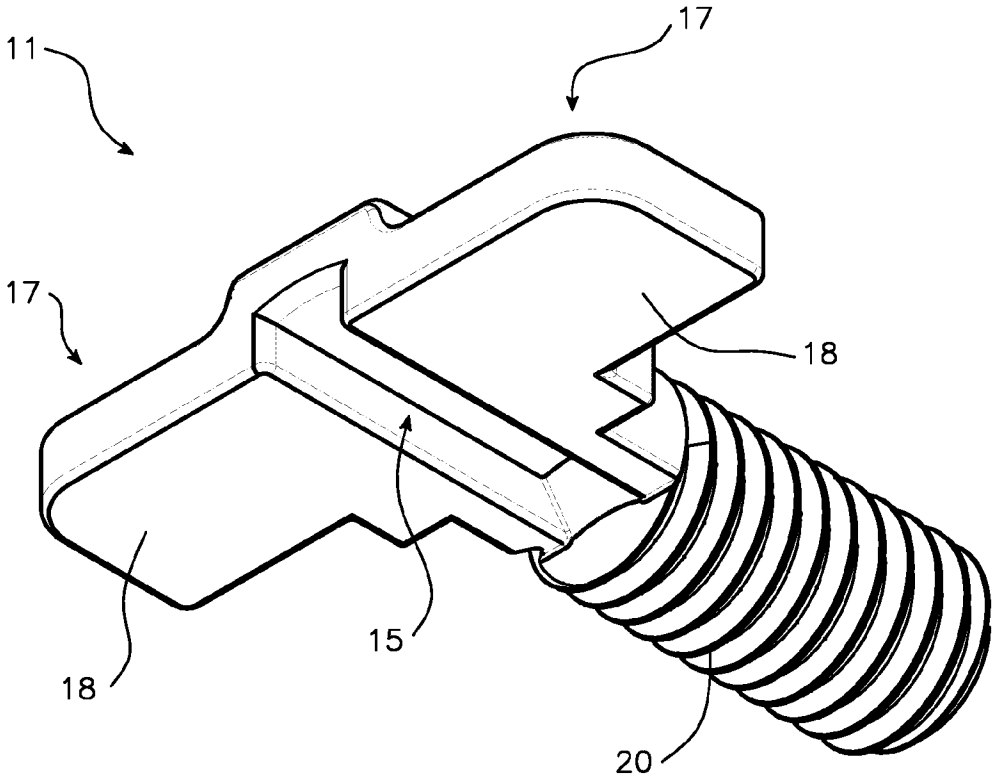
FIG. 4 is a view of the underside of one of the components of the apparatus of FIGS. 1 and 2.

The supporting body portion 11 further includes an elongate channel 15 in a lower portion thereof (as best seen in FIG. 4), extending at least partially along the underside of the body portion and adapted to locate over a fret 16 of the stringed instrument 14.

In this instance, the supporting body portion 11 includes stabilising plates 17 extending laterally from each side of the central element 26 in which elongate channel 15 is located. Stabilising plates 17 include substantially flat underside portions 18 for supportive contact of the supporting body portion 11 against the upper surface of the neck 14 of the stringed instrument. The arrangement is such that contact between the string 13 and the bottom of slot 12, and the contact of the flat underside portions 18 of the stabilising plates 17 with the surface of neck 14, ensures transfer of string vibration to the neck 14 of the stringed instrument and to the rest of the instrument.

The slot 12 in the upper portion of supporting body portion 11 is sized and oriented so as to support and retain string 13 therein, thereby, in use, raising the string 13 above fret 16 to a height slightly higher than its originally position, that is its position without the tensioning apparatus 10 of the invention in place.

In a preferred form, the supporting body portion 11 is made substantially or entirely from a rigid material such as bronze, brass, steel or a rigid plastic.

With specific reference to FIG. 2, the effect of insertion and placement of the tensioning apparatus 10 is to displace the string substantially perpendicularly to the surface 19 of the neck 14 of the instrument and raise the height of string 13 a distance, H above fret 16 compared with its position prior to insertion of the tensioning apparatus 10. In this way the length of the string 13 is effectively shortened thereby increasing its pitch.

Figure 5B:
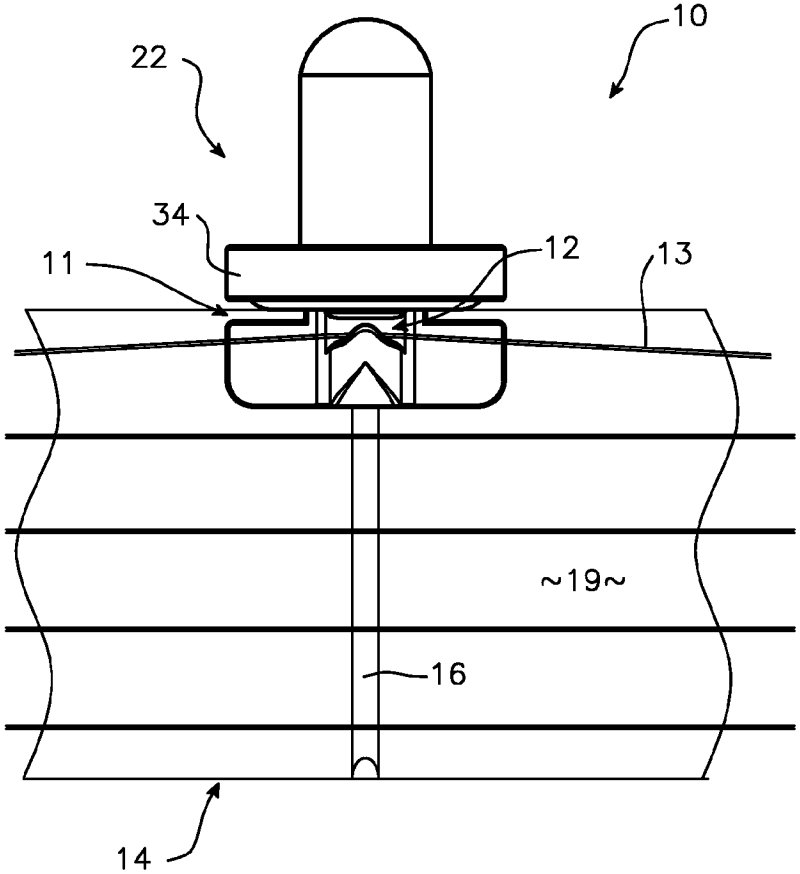
FIGS. 5A and 5B are top views of the apparatus of FIG. 1 in a laterally un-tensioned and in a laterally tensioned state.
Figure 5A:
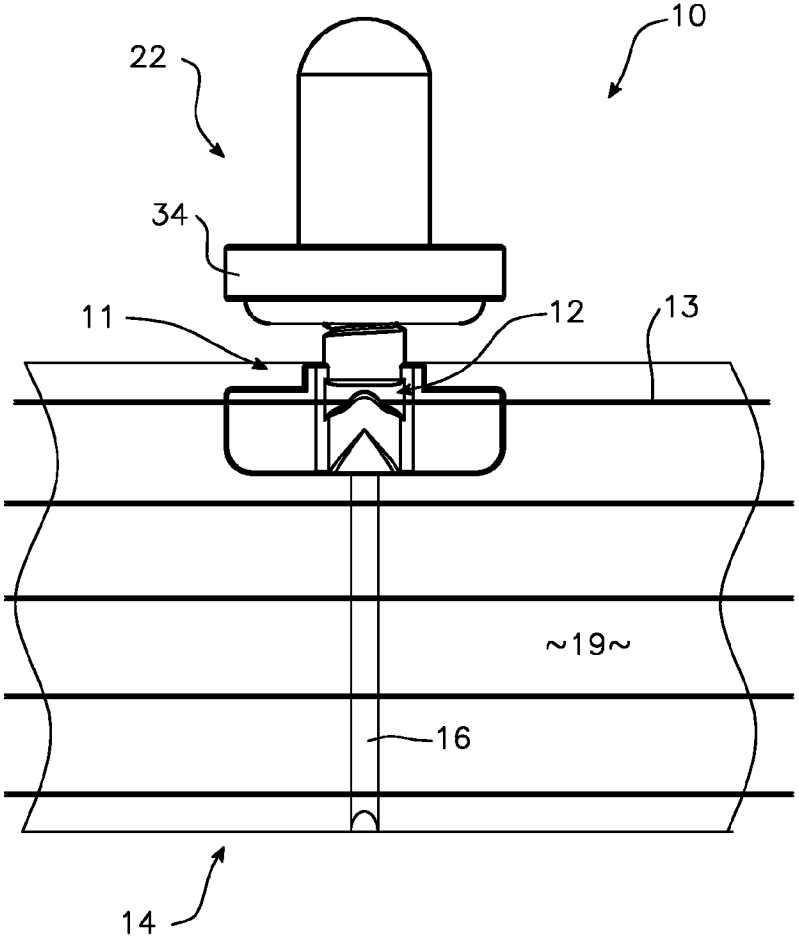
Figure 6B:
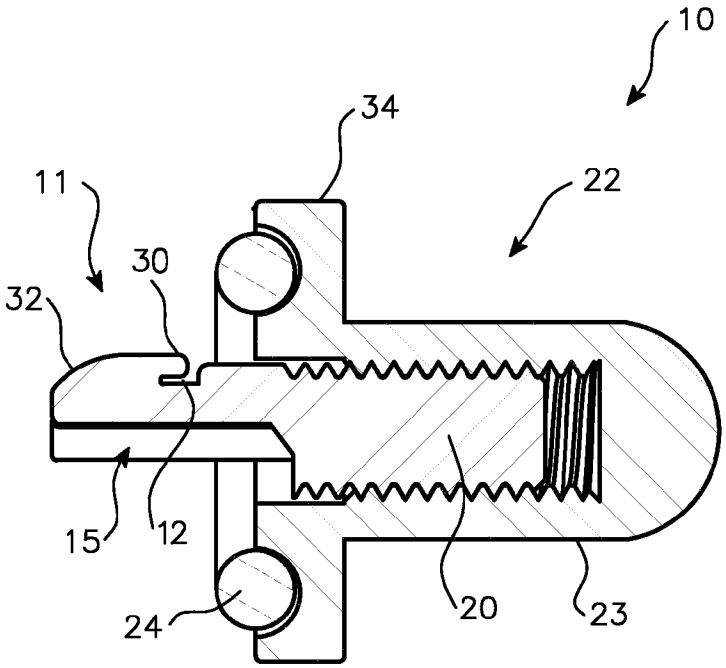
FIGS. 6A and 6B respectively show a front and side sectioned view of the apparatus of FIGS. 1 to 5.
Figure 6A:
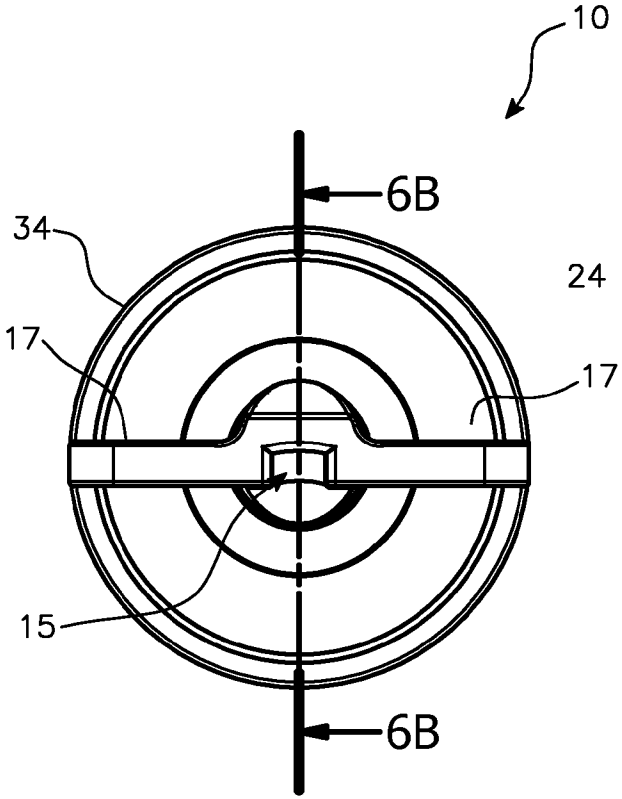

In this instance, the supporting body portion 11 includes a threaded portion 20 extending outwardly from the central element 26 and stabilising plates 17. The threaded portion 20 is adapted, in use, to extend from a side edge 21 the neck 14 of a stringed instrument, as best seen in FIGS. 1, 5A and 5B. Threaded portion 20 engages with and forms part of a biasing device 22. Again, as best seen in FIGS. 1, 2 and 6B, in use, the biasing device 22, in one form, comprises an internally threaded wheel portion 34 and knob portion 23. Preferably the inward facing side of the threaded wheel portion 34 is provided with a cushioning element 24 to prevent damaging the edge of the neck 14 as the knob is rotated when in contact with the neck. Preferably, cushioning element 24 comprises a rubber or like resilient material "O" ring seated in annular groove 36 of wheel portion 34.

In Use

With reference to FIGS. 1, 5A, 5B, 6A and 6B, when in use with the supporting body portion 11 inserted over a fret 16 and the string 13 captured in slot 12, the biasing device 22 can be engaged with and rotated upon the threaded portion 20 in such a manner that distance between the cushioning portion 24 and side edge 21 of the neck 14 reduces until contact is made between cushioning portion 24 and side edge 21. Any further rotation from this point causes a drawing of supporting body portion 11 and the string transversely relative the neck 14 towards side edge 21. This action biases string 13 towards side edge 21, drawing it aside from its normal operating position relative the neck 14 prior to the insertion of the tensioning apparatus 10. This biasing action by biasing device 22 further tensions string 13 and, in addition assists in the transfer of tone-generating vibrations to the stringed instrument.

In order to gain a complete understanding of the mechanism employed in the present invention which improves the resonant tone of the instrument string, the following description is provided referencing the application of the tensioning apparatus 10 to the fifth string of a five-string banjo. The tensioning apparatus is inserted between the string and the fret board from the side of the instrument. The height of the tensioning apparatus is greater than the distance between the string and the fret board, thereby raising the string as the apparatus passes underneath the string. At an appropriate insertion distance, the string slips into and is engaged in the string slot which is of an appropriate thickness and with an appropriate depth, ensuring that the string is raised to a height slightly higher than its original position prior to the insertion of the tensioning apparatus. This string elevation against a rigid surface effectively reduces its length thereby increasing its pitch. As the tensioning apparatus is comprised of rigid material such as bronze, brass, steel or rigid plastic and stabilized against the neck with flat stabilizing plates that are part of the tensioning apparatus that are in contact with the fret board, tone generating vibration is efficiently transferred to the rest of the instrument for sound processing.

To further aid in the capture and transfer of string vibration to the rest of the instrument, the inserted tensioning apparatus includes a stabilizing adjustment wheel as part of the biasing device positioned on the side edge of the instrument utilizing a standard thread and nut mechanism. The internally threaded wheel which is in contact with the side of the instrument is rotated until it meets resistance caused by the tension generated with transverse movement of the tensioning apparatus and the captured string in the slot located on the tensioning apparatus. This resistance and transverse deflection of the string furthers the string contact and enhances the transfer of tone generating vibration to the instrument.

The invention claimed is:

1. A tensioning apparatus for a string of a stringed instrument, the apparatus including a supporting body portion for releasable engagement between a string and a surface of the neck of the stringed instrument at a fret on the fret board, thereby to raise the string relative to the fret on the fret board; the apparatus further including a biasing element by which lateral tension may be applied to the string.

2. The apparatus of claim 1 wherein the supporting body comprises a central element provided with a string retaining slot in a top portion of the central element; the supporting body further comprising stabilising plates for placement against a surface of a neck of the stringed instrument.

3. The apparatus of claim 2 wherein the supporting body portion is provided at an underside with a groove; the groove sized so as to locate over the fret with the stabilising plates in contact with the surface of the neck of the stringed instrument.

4. The apparatus of claim 3 wherein the supporting body includes an externally threaded element extending from the central element; the threaded element extending from a side of the neck when the apparatus is inserted between the fret and the string with the stabilising plates in contact with the surface of the neck for use.

5. The apparatus of claim 4 wherein the biasing element comprises internally threaded wheel and knob elements for engagement with the externally threaded element.

6. The apparatus of claim 5 wherein the internally threaded wheel element is further provided with a cushioning element at an inward facing side of the wheel element; the cushioning element preventing damage to a side of the neck of the instrument when the biasing element is urged into contact with the neck.

7. The apparatus of claim 6 wherein the cushioning element is in the form of a resilient "O" ring located in an annular groove of the wheel element.

8. The apparatus of claim 5 wherein advancing the biasing element on the externally threaded element after the biasing element has come into contact with the side of the neck draws the supporting body portion and the string towards the side of the neck so as to displace the string laterally from it normal position thereby applying the lateral tension to the string.

9. A capo device for use at the fifth string of a banjo musical instrument; the capo device raising the fifth string above a selected fret; the capo device characterised in providing for lateral displacement of the fifth string towards an edge of the neck of the banjo; the displacement providing an additional tensioning of the fifth string.

10. The capo device of claim 9 wherein the fifth string is captured in a slot of a supporting body element; the supporting body element provided with an externally threaded element extending outwardly from the edge of the neck when in use; the capo device further including an internally threaded biasing element; the biasing element laterally displacing the supporting body element and captured string when the biasing element is advanced on the threaded element against the edge of the neck of the banjo.

11. A method of applying additional tension to the string of a stringed instrument at a fret along a neck of the stringed instrument; the method comprising the steps of:

(a) inserting a supporting body portion of a tensioning apparatus between the string and the fret so as to capture the string in a slot of the supporting body portion; the insertion displacing the string perpendicularly relative the surface of the neck and relative the fret, (b) advancing a biasing element of the tensioning apparatus against a side of the neck so as to draw the supporting body towards the side of the neck thereby displacing the string laterally towards the side of the neck.

12. A method of altering a tuning of a stringed musical instrument; the method including insertion of a capo device at a fret along a neck of the musical instrument between the surface of the neck and the string to raise the string relative the fret; the method further including urging a biasing element of the capo device against a side of the neck so as to laterally displace and tension the string.

* * * * *